US009475510B2

(12) United States Patent
Porsch et al.

(10) Patent No.: US 9,475,510 B2
(45) Date of Patent: Oct. 25, 2016

(54) METHOD FOR GENERATING ACTION RECOMMENDATIONS FOR THE DRIVER OF A RAIL VEHICLE OR CONTROL SIGNALS FOR THE RAIL VEHICLE BY MEANS OF A DRIVER ASSISTANCE SYSTEM, AND DRIVER ASSISTANCE SYSTEM

(71) Applicant: SIEMENS AKTIENGESELLSCHAFT, Munich (DE)

(72) Inventors: Roland Porsch, Speichersdorf (DE); Patrick Schmidt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 3 days.

(21) Appl. No.: 14/397,253

(22) PCT Filed: Apr. 24, 2013

(86) PCT No.: PCT/EP2013/058440

§ 371 (c)(1),
(2) Date: Oct. 27, 2014

(87) PCT Pub. No.: WO2013/160327

PCT Pub. Date: Oct. 31, 2013

(65) Prior Publication Data

US 2015/0329128 A1 Nov. 19, 2015

(30) Foreign Application Priority Data

Apr. 25, 2012 (DE) ..... 10 2012 206 859

(51) Int. Cl.
*G05D 1/00* (2006.01)
*B61L 3/00* (2006.01)

(Continued)

(52) U.S. Cl.
CPC ..... *B61L 3/00* (2013.01); *B61L 3/006* (2013.01); *B61L 27/04* (2013.01); *B61L 27/0027* (2013.01)

(58) Field of Classification Search
CPC ..... B61L 3/00; B61L 27/04
USPC ..... 701/19, 20; 318/376–381
See application file for complete search history.

(56) References Cited

U.S. PATENT DOCUMENTS

2005/0109882 A1* 5/2005 Armbruster et al. ..... 246/167 R
2009/0118970 A1 5/2009 Daum et al.
2010/0023190 A1 1/2010 Kumar et al.

(Continued)

FOREIGN PATENT DOCUMENTS

CN 1882454 A 12/2006
CN 101909965 A 12/2010

(Continued)

*Primary Examiner* — Thomas G Black
*Assistant Examiner* — Luke Huynh
(74) *Attorney, Agent, or Firm* — Laurence Greenberg; Werner Stemer; Ralph Locher

(57) ABSTRACT

A method for generating action recommendations for the driver of a rail vehicle or control signals for the rail vehicle by way of a driver assistance system. Taking at least one journey specification into account, driving data is calculated and on the basis of the driving data: an action recommendation is generated and displayed in an action recommendation display device or a control signal that acts on a vehicle control device is generated. In order to optimize such a method in relation to an energy requirement of the rail vehicle, at least one air pressure characteristic variable is taken into account as a journey specification.

9 Claims, 2 Drawing Sheets

(51) Int. Cl.
*B61L 27/04* (2006.01)
*B61L 27/00* (2006.01)

(56) References Cited

U.S. PATENT DOCUMENTS

2012/0143407 A1* 6/2012 Murthy ..... B60T 13/665 701/19
2013/0245863 A1* 9/2013 Frazier et al. ..... 701/19
2014/0046511 A1* 2/2014 Uzkan et al. ..... 701/19

FOREIGN PATENT DOCUMENTS

DE 10159957 A1 6/2003
RU 2306255 C1 9/2007

* cited by examiner

28

| | |
|---|---|
| $[L_1^A, \quad L_1^E,]$ | $F_1$ |
| $[L_2^A, \quad L_2^E,]$ | $F_2$ |
| $[L_3^A, \quad L_3^E,]$ | $F_3$ |
| ⋮ | ⋮ |
| $[L_{N-1}^A, L_{N-1}^E,]$ | $F_{N-1}$ |
| $[L_N^A, \quad L_N^E,]$ | $F_N$ |

FIG. 3

METHOD FOR GENERATING ACTION RECOMMENDATIONS FOR THE DRIVER OF A RAIL VEHICLE OR CONTROL SIGNALS FOR THE RAIL VEHICLE BY MEANS OF A DRIVER ASSISTANCE SYSTEM, AND DRIVER ASSISTANCE SYSTEM

Method for generating action recommendations for the driver of a rail vehicle or control signals for the rail vehicle by means of a driver assistance system, and driver assistance system.

BACKGROUND OF THE INVENTION

Field of the Invention

The invention relates to a method for generating action recommendations for the driver of a rail vehicle or control signals for the rail vehicle by means of a driver assistance system, in which, taking at least one journey specification into account, driving data is calculated, and on the basis of the driving data:

- an action recommendation is generated and displayed in an action recommendation display device, or
- a control signal which acts on a vehicle control device is generated.

It is known to use, in semi-automatic operation with rail vehicles, driver assistance systems which are based on model calculations. These model calculations determine, on the basis of a stored route profile and the desired timetable, how the rail vehicle is to be accelerated and braked before bends, railroad switches or stopping points in order to comply with the requirements of the timetable while requiring a minimum amount of energy. In this context, it has been shown in practice that compared to vehicles which are controlled only by the vehicle driver, driver assistance systems can reduce the energy requirement by an average of 20% with the same travel time.

BRIEF SUMMARY OF THE INVENTION

The invention is based on the object of proposing a method for generating action recommendations for the driver of a rail vehicle or control signals for the rail vehicle by means of which an energy requirement can be reduced further, in particular in the case of high speed journeys.

For this purpose it is proposed that at least one air pressure characteristic variable is taken into account as a journey specification. As a result, at least one aerodynamic portion of the driving resistance of the rail vehicle can be taken into account in the calculation of the driving data for an action recommendation or a control signal by including a characteristic variable, related to a current air pressure, in a model calculation on which the determination of the driving data is based. In contrast to conventional driver assistance methods in which the aerodynamic portion is taken into account as a constant in the model calculations, increased energy savings can be achieved, in particular in the case of high speed journeys and large differences in altitude. A "high speed journey" is to be understood here as meaning, in particular, a journey in which a speed above 200 km/h, preferably above 250 km/h, is reached.

A "journey specification" is to be understood as, in particular, a specification which characterizes the journey of a rail vehicle along a route at least at a point in time or during a time period or at least at one position along the route or in a route section. A journey specification can be an input parameter of a model calculation for determining the driving data or it can be used for the derivation of such an input parameter, for example by assigning the input parameter to the journey specification. A journey specification which is already taken into account in conventional driver assistance methods can be a property of the rail vehicle such as, for example, a train composition, a mass, passenger occupancy, maximum available power etc. or a property of the route such as a specific bend profile, positive gradient profile or negative gradient profile, the presence or the approaching of a railroad switch or of a tunnel, distance from a stopping point, a signal status, a timetable etc. Taking into account an air pressure characteristic variable as a journey specification according to the invention can enable already existing model calculations to be advantageously refined.

From the "driving data" which are used to generate an action recommendation or a control signal it is possible to derive driving properties, such as in particular a speed, an acceleration, a deceleration, a stopping time etc., which are to be complied with in order to minimize the energy requirement. A set of driving data which contains, as information content, in particular a setpoint change in such driving properties over time and/or over distance from the starting point or from the destination can also be referred to as a "driving curve". The driving data is calculated by a computing unit which is preferably arranged on board the rail vehicle. Alternatively or additionally, the driving data can be calculated by means of a computing unit which is arranged remote from the rail vehicle in a fixed computing station, wherein the driving data are transmitted to the rail vehicle.

An "air pressure characteristic variable" is to be understood as meaning, in particular, a physical variable by means of which the correspondence with an air pressure value can be brought about. The air pressure characteristic variable can be the air pressure itself or a characteristic variable which is proportional to the air pressure such as, for example, an electrical characteristic variable which is detected by a sensor unit.

According to one embodiment of the invention, by detecting or determining air pressure characteristic variables once before a journey of the rail vehicle, an air pressure profile of the route to be travelled along can be produced, said air pressure profile being included in the calculation of driving curves for the entire route.

However, in a further preferred embodiment variant, in order advantageously to adapt the driving data for energy optimization to an air pressure which can vary along the route, it is proposed that the air pressure characteristic variable be detected repeatedly during a journey. In particular, the air pressure characteristic variable can be detected continuously during the journey. The "journey" occurs expediently along a route which connects a predefined starting point and a predefined destination and which is to be travelled along according to a timetable which is to be complied with.

Furthermore, it is proposed that the air pressure characteristic variable be detected, and that a factor which is stored in a database be included in the calculation of the driving data as a function of the detection value. Through the assignment of a factor to a detected value of the air pressure characteristic variable, wherein the factor is permanently stored in a memory unit, the driving data can be determined particularly quickly. The factor which is assigned to the detected air pressure characteristic variable is preferably included as an input parameter of a model calculation for the determination of the driving data, wherein said factor constitutes an aerodynamic portion of the driving resistance of the rail vehicle. In this context, said factor is selected in the database which is stored in the memory unit and in which factors relating to values of the air pressure characteristic variable are assigned. The stored factors are advantageously calculated during the development of the rail vehicle on the basis of the aerodynamic properties thereof and for different values of the air pressure characteristic variable. If a computing unit for calculating the driving data is arranged on board the rail vehicle, the database is preferably also stored on board the rail vehicle.

The air pressure characteristic variable can be detected, for example, by means of air pressure sensors which are arranged at different locations along the route. They can be components of weather stations which are arranged in the vicinity of the route. However, the air pressure characteristic variable can also be detected at any desired position along the route if the air pressure characteristic variable is detected by a sensor unit on board the rail vehicle. This sensor unit can have a pressure sensor and a computing unit which is connected thereto and which is used to take into account the influence of the velocity on the detection value.

Alternatively or additionally to detection by means of a pressure sensor, the air pressure characteristic variable can be detected by means of the detection of an altitude characteristic variable. A correspondence of the altitude characteristic variable to an air pressure characteristic variable can be brought about here by means of the barometric altitude formula. The altitude characteristic variable can itself serve as an air pressure characteristic variable in that it is included directly as an input parameter of a model calculation for determining the driving data or is directly assigned to such an input parameter, or, in addition to the altitude characteristic variable, a separate air pressure characteristic variable can be calculated from the altitude characteristic variable.

The altitude characteristic variable is advantageously derived on the basis of locating information. This information can be detected by means of a locating unit which is arranged, in particular, on board the rail vehicle and/or can be determined on the basis of stored route data.

The invention also relates to a driver assistance system for generating action recommendations for the driver of a rail vehicle or control signals for the rail vehicle, having a computing unit which is provided for calculating driving data taking at least one journey specification into account, and an action recommendation display device for displaying an action recommendation which is generated on the basis of the driving data, and/or a vehicle control device on which a control signal which is generated on the basis of the driving data acts.

BRIEF DESCRIPTION OF THE SEVERAL VIEWS OF THE DRAWINGS

In order to configure such a driver assistance system in such a way that an energy requirement can be reduced further, in particular in the case of high speed journeys, it is proposed that the computing unit be provided for taking into account at least one air pressure characteristic variable as a journey specification. With such a driver assistance system is it accordingly possible to achieve the same advantages as have already been specified above in relation to the method according to the invention. An exemplary embodiment of the invention is explained on the basis of the drawing, in which:

FIG. 3 shows a database in which values of an air pressure characteristic variable are assigned calculation factors for a model calculation of the driver assistance system.

DESCRIPTION OF THE INVENTION

Figure 1:
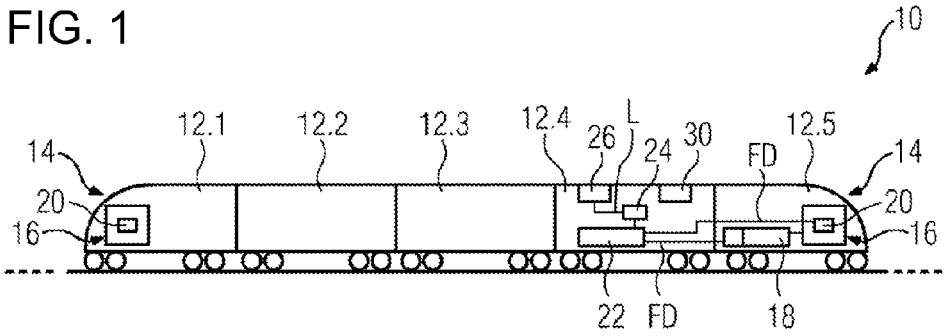
FIG. 1 shows a rail vehicle having a driver assistance system.

FIG. 1 shows a rail vehicle 10 in a schematic side view. The latter is embodied as a motor train set which is configured, in particular, for high speed operation. Said rail vehicle 10 has a multiplicity of cars 12 which are coupled to one another. The end cars 12.1 and 12.5 are each equipped with a driver's cab 14, each of which has an operator control unit 16 for a traction unit driver. These driving instructions for controlling the rail vehicle 10 can be input by means of the operator control unit 16. For this purpose, the operator control unit 16 is operatively connected to a vehicle control device 18.

The operator control unit 16 has an action recommendation display device 20 which serves to display an action recommendation for the traction unit driver. This action recommendation is generated on the basis of driving data FD which is determined in a computing unit 22 taking into account journey specifications. An action recommendation can be, in particular, a recommended velocity, traction stage, braking stage etc., wherein the information content of the calculated driving data FD is related to these driving parameters. The computing unit 22 is provided for calculating the driving data FD on the basis of at least one model calculation M. This model calculation M determines, at least taking into account a route profile S and a desired timetable FP as journey specifications, how the rail vehicle 10 is to be accelerated and to be braked before bends, railroad switches or stopping points in order to maintain the requirements of the timetable while requiring a minimum amount of energy. Such a model calculation M can determine, for example, an acceleration a, optimized with respect to the energy requirement, as a function of a current position x and speed v of the rail vehicle 10 according to $$a(x)=M(x,v(x),S(x),FP),$$

where S(x) represents the conditions of the route in a route section starting from the position x and FP represents the timetable. The route data of the route profile S or of the timetable FP can be stored in a memory unit 24 connected by data technology to the computing unit 22, in particular when the rail vehicle 10 is retrofitted at the starting point before the departure. The acceleration a or information based on this variable is then a component of the driving data FD which are transmitted to the action recommendation display device 20.

In addition, the control of the rail vehicle 10 can be performed by the vehicle control device 18 during the journey. In this mode, actions which are performed by the traction unit driver by means of the operator control unit 16 during normal operation are carried out automatically by the vehicle control device 18. In this mode, a control signal which is generated on the basis of driving data FD which is determined in the computing unit 22 can act on the vehicle control device 18. As a result, the driving operation of the rail vehicle 10 can be optimized with respect to the journey specifications in the automatic control mode in that control signals are generated, on the basis of a driving curve which is determined optimized with respect to the journey specifications, and are transmitted to the vehicle control device 18.

Figure 2:
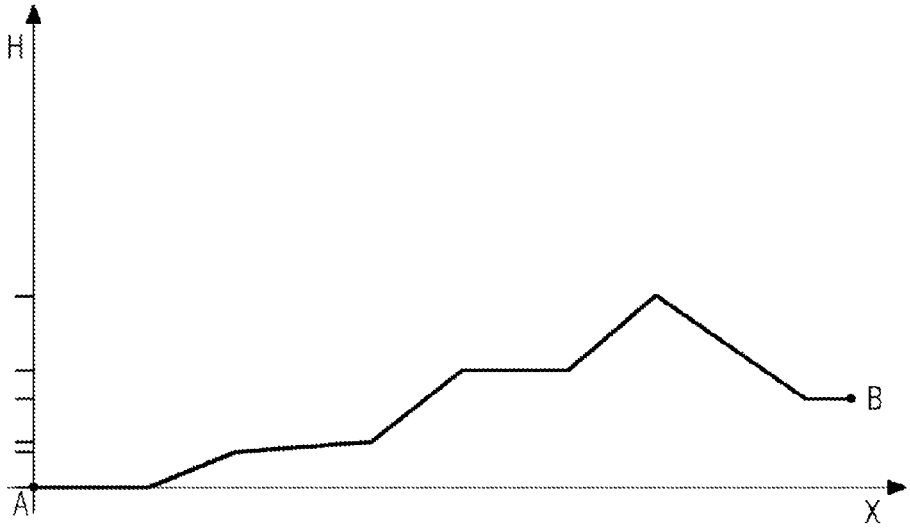
FIG. 2 shows an altitude profile of a route travelled by the rail vehicle.

FIG. 2 shows, in the form of a two-dimensional diagram, a route profile of a route which is to be travelled along by the rail vehicle 10, from a starting point A to a destination B. The horizontal axis corresponds to the distance x from the starting point A, and the vertical axis corresponds to the altitude H. As is apparent from the altitude profile, there are large differences in the altitude H along the route and accordingly changes in air pressure which are relevant for the driving dynamics.

The computing unit 22 is provided for determining the driving data FD taking into account a journey specification in the form of a characteristic variable, also referred to as the air pressure characteristic variable L, which is based on the current air pressure.

According to a first detection variant, the air pressure characteristic variable L is detected by means of a sensor unit 26 which is arranged on board the rail vehicle 10 (see FIG. 1). The sensor unit 26 has a pressure sensor which detects a characteristic variable for the pressure of the air surrounding the rail vehicle 10 and, if appropriate, a computing unit which derives the air pressure characteristic variable L from the detection value by taking into account the current velocity v. The air pressure characteristic variable L can be detected continuously during the entire journey, as a result of which the driving data FD can always be adapted to the continuously changing air pressure.

The detected air pressure characteristic variable L is greatly influenced by a journey of the rail vehicle 10 in a tunnel. Accordingly, it is advantageous to take into account the time spent by the rail vehicle 10 in a tunnel during the detection of the air pressure characteristic variable L. This can be done, in particular, on the basis of the route data of the route profile S which is stored in the memory unit 24 during the retrofitting of the rail vehicle 10 at the starting point A.

After the detection of the air pressure characteristic variable L, the latter is included in the determination of the driving data FD by the computing unit 22. This is done by means of a database 28 which is shown in FIG. 3 and which is stored in the memory unit 24. A factor $F_i$, which represents an aerodynamic portion of the driving resistance in a model calculation M', can be assigned to a detection value of the air pressure characteristic variable L in a specific interval $[L_i^A, L_i^E]$ by means of this database 28. This model calculation M', which is programmed on the basis of a driving resistance formula, takes into account the factor $F_i$ corresponding to the air pressure characteristic variable L, during the determination of the driving data FD. Coming back to the above example of a recommended acceleration a, optimized with respect to the energy requirement, at a position x, the acceleration determination can be expressed schematically as $$a(x)=M'(x,v(x),S(x),FP,F_i(x)),$$

where $F_i(x)$ is the factor assigned to the air pressure characteristic variable L (x) at the position x.

The database 28 is produced on the basis of the aerodynamic properties of the rail vehicle 10 during the manufacture of the rail vehicle 10 and is permanently stored in the memory unit 24.

According to a second detection variant, the air pressure characteristic variable L can be detected by the detection of an altitude characteristic variable H, wherein linking can be brought about between these two characteristic variables L and H by means of the barometric altitude formula. The altitude characteristic variable H can be determined, in particular, from locating information of a locating unit 30 arranged on board the rail vehicle 10. For example, the locating unit 30 can be designed to receive GPS signals. Alternatively or additionally, the altitude characteristic variable H can be derived from the known route data of the route profile S.

In the exemplary embodiment shown, the computing unit 22 and the sensor unit 26 are arranged on board the rail vehicle 10. In further embodiments it is conceivable for the computing unit 22 to be arranged remotely from the vehicle in a fixed computing station, wherein the determined driving data FD are transmitted to the rail vehicle 10 and/or that the sensor unit 26 is embodied as a fixed unit, for example as part of a weather station, located along the route.

The invention claimed is:

1. A method of generating action recommendations for the driver of a rail vehicle or control signals for the rail vehicle, the method comprising:

detecting an air pressure characteristic variable as a detection value;

calculating driving data with a driver assistance system and thereby taking into account at least one air pressure characteristic value forming a journey specification and also taking into account a factor which is stored in a database as a function of the detection value; and based on the driving data:

generating an action recommendation and displaying the action recommendation in an action recommendation display device; or generating a control signal acting on a vehicle control device.

2. The method according to claim 1, which comprises repeatedly detecting the air pressure characteristic variable during a journey.

3. The method according to claim 1, which comprises detecting the air pressure characteristic variable with a sensor unit on board the rail vehicle.

4. The method according to claim 1, which comprises detecting the air pressure characteristic variable by way of a detection of an altitude characteristic variable.

5. The method according to claim 4, which comprises deriving the altitude characteristic variable on a basis of location information.

6. The method according to claim 5, which comprises detecting the location information by way of a locating unit.

7. The method according to claim 5, wherein the location information is determined on the basis of stored route data.

8. A driver assistance system for generating action recommendations for the driver of a rail vehicle or control signals for the rail vehicle, the system comprising:

a computing unit configured for calculating driving data taking into account at least one air pressure characteristic variable forming at least one journey specification;

said computing unit being configured for generating action recommendations for the driver of the rail vehicle and control signals for the rail vehicle; and an action recommendation display device disposed to receive from said computing unit calculated driving data and configured for displaying the action recommendation generated based on the driving data; or a vehicle control device disposed to receive from said computing unit the calculated driving data and subject to the control signal generated on a basis of the driving data.

9. A rail vehicle, comprising a driver assistance system according to claim 8.

* * * * *